United States Patent [19]

Base

[11] 4,325,509

[45] Apr. 20, 1982

[54] HOME HEATING APPARATUS

[76] Inventor: Leonard C. Base, Rte. #3, Kingman, Kans. 67068

[21] Appl. No.: 82,610

[22] Filed: Oct. 9, 1979

[51] Int. Cl.[3] ..... F24B 7/00

[52] U.S. Cl. ..... 237/51; 237/55; 165/DIG. 2; 126/122; 126/121

[58] Field of Search ..... 237/55, 54, 50, 51; 165/DIG. 2, 129; 126/122, 121, 110 R; 122/20 B

[56] References Cited

U.S. PATENT DOCUMENTS

| | | | |
|---|---|---|---|
| 1,371,390 | 3/1921 | Olds | 126/121 |
| 1,440,384 | 1/1923 | Forcier | 237/46 |

FOREIGN PATENT DOCUMENTS

| | | | |
|---|---|---|---|
| PCT00045 | 7/1979 | Fed. Rep. of Germany | 165/DIG. 2 |
| 52-13001 | 1/1977 | Japan | 122/20 B |
| 7709614 | 4/1979 | Sweden | 165/DIG. 2 |

*Primary Examiner*—Albert J. Makay
*Assistant Examiner*—Henry Bennett
*Attorney, Agent, or Firm*—John H. Widdowson

[57] ABSTRACT

A heating process and apparatus for a dwelling having a fireplace with a flue. A conduit communicates with the flue and includes an inlet terminating in the exterior of the dwelling and a discharge terminating within the dwelling.

3 Claims, 4 Drawing Figures

FIG. 1
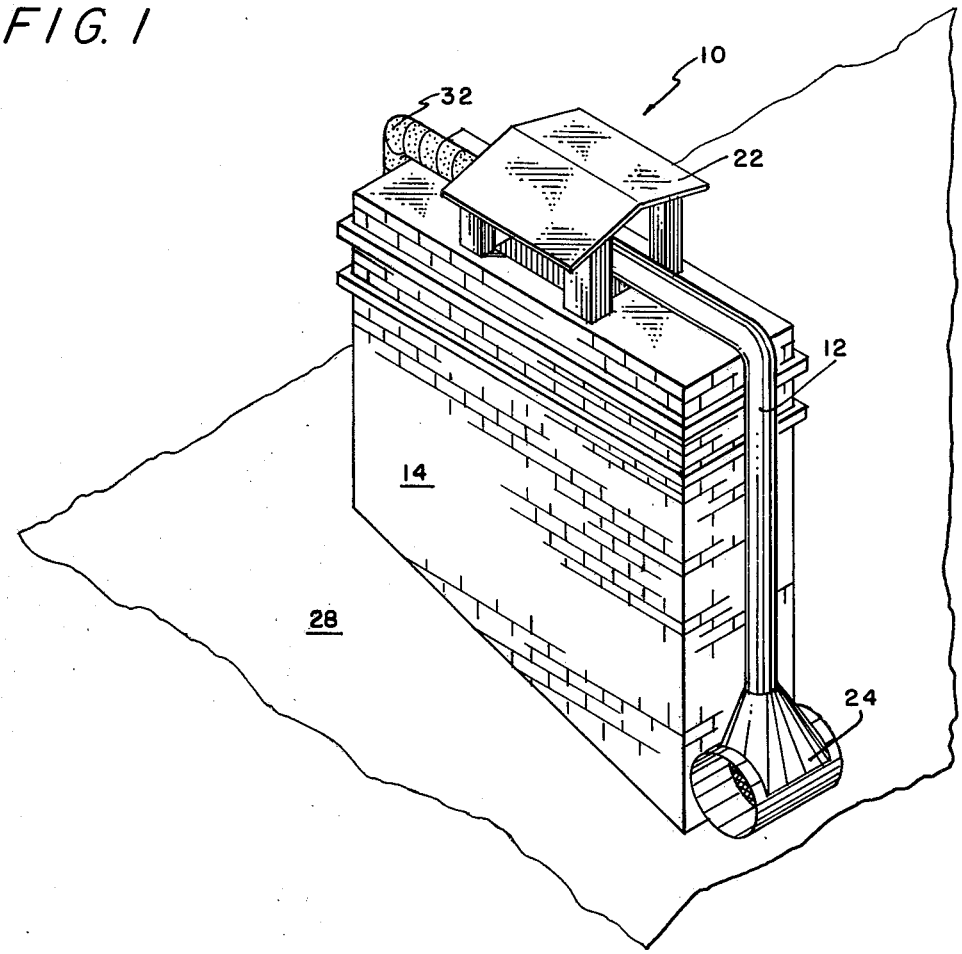
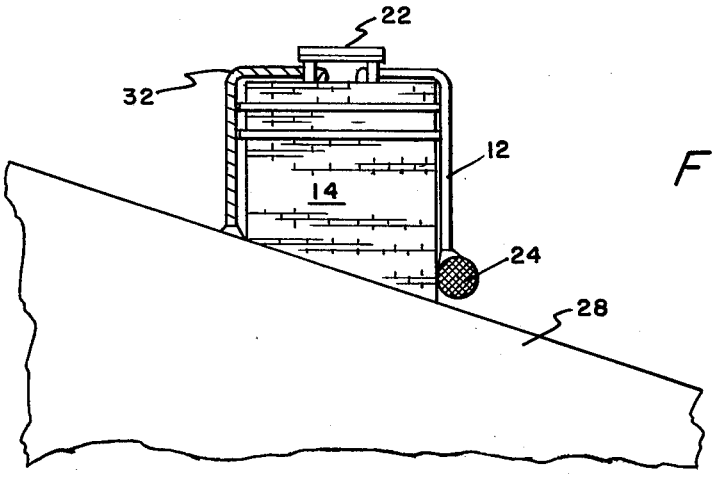
FIG. 2

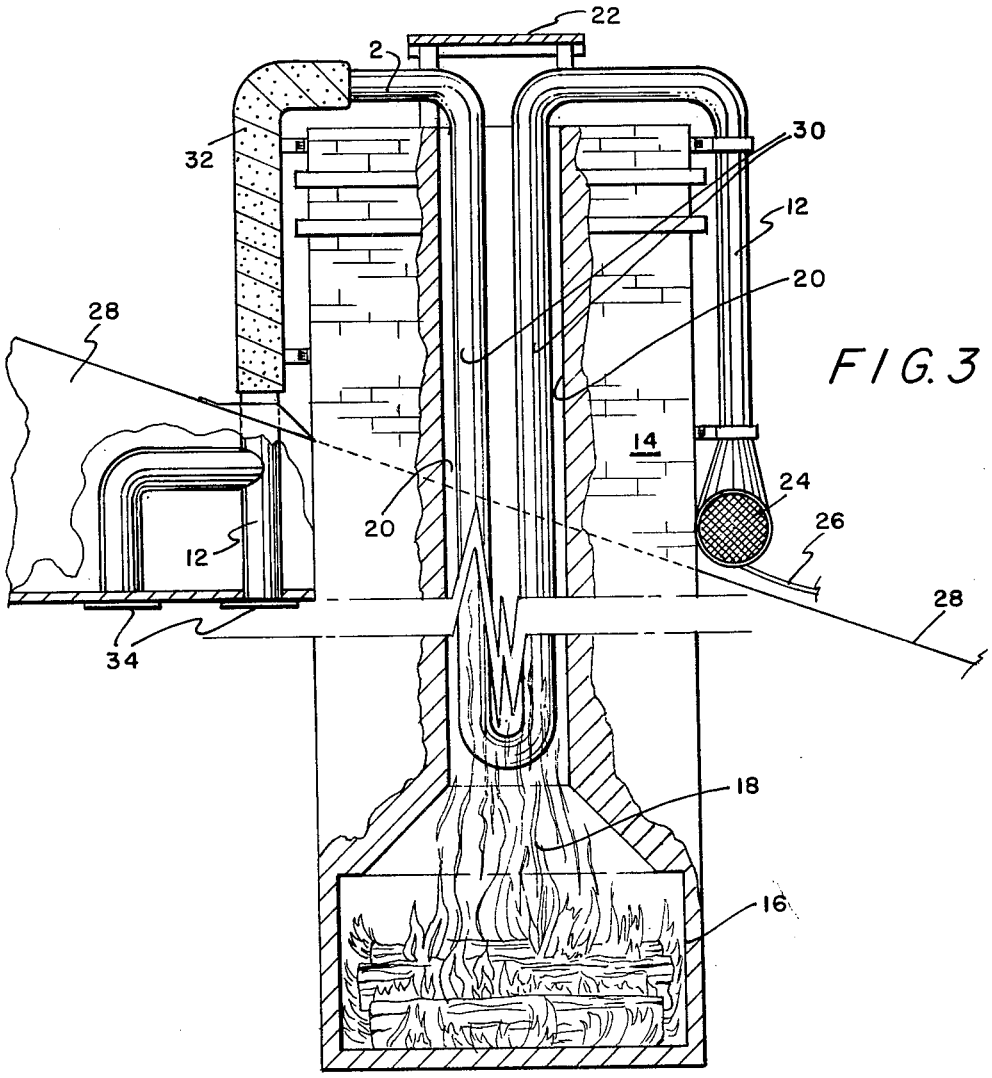
FIG. 3
FIG. 4
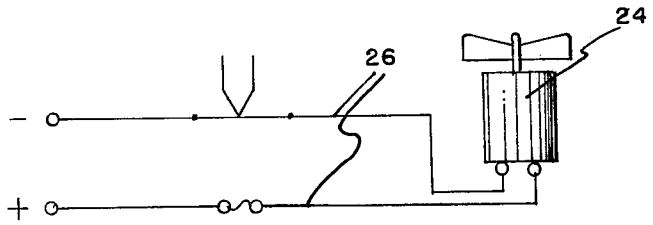

HOME HEATING APPARATUS

BACKGROUND OF THE INVENTION

1. Field of the Invention

This invention is related to a heating apparatus for a dwelling. More specifically, this invention provides for a process and heating apparatus which uses flue heat in a chimney of a dwelling to heat atmospheric air for exhausting into the dwelling.

2. Description of the Prior Art

U.S. Pat. No. 4,142,679 by McKillop, Sr. discloses a building heating system. U.S. Pat. No. 1,984,949 and U.S. Pat. No. 2,402,907 by Smith and Mueller, respectively, teach heating apparatuses for building. None of the foregoing prior art teach or disclose the process and apparatus of this invention.

SUMMARY OF THE INVENTION

This invention accomplishes its desired objects by providing a heating apparatus for a dwelling having a flue and including a conduit having an inlet terminating in the exterior of the dwelling and a discharge terminating within the dwelling. The conduit communicates with the flue. A process of heating a dwelling having a fireplace is provided and comprises introducing air from the exterior of the dwelling through the conduit communicating with the fireplace. The conduit is exhausted into the interior of the dwelling such that in operation the fireplace heat on the conduit is operative to draw air from the exterior and circulate warm air into the dwelling. Also, provided in this invention is a method of preventing cold air from seeping through cracks, crevices, or the like, in the dwelling having a fireplace with a flue by use of an air-intake blower exhausting air through discharge vents in the dwelling to pressurize the inside of the dwelling thereby preventing cold air from seeping through the cracks, crevices, and the like.

It is an object of this invention to provide a novel heating apparatus for a dwelling.

Still further objects of the invention reside in the provision of a heating apparatus for a dwelling which utilizes outside air heated by flue heat in a chimney of the dwelling, and is relatively inexpensive to manufacture.

These together with the various ancillary objects and features will become apparent as the following description proceeds, are attained by this heating apparatus, a preferred embodiment being shown in the accompanying drawings, by way of example only, wherein:

BRIEF DESCRIPTION OF THE DRAWINGS

FIG. 1 is a partial perspective view of the invention;

FIG. 2 is a side elevational view of an embodiment of the invention;

FIG. 3 is a partial vertical sectional view of the invention positioned in the flue of a chimney and disclosing discharge vents in the dwelling where heated air is discharged; and FIG. 4 is a schematic electrical diagram of the intake blower.

DETAILED DESCRIPTION OF THE INVENTION

Referring in detail now to the drawings, wherein like reference numerals designate similar parts throughout the various views, there is seen an embodiment of the invention, generally illustrated as 10, including a conduit 12, attached to a chimney 14 having a fireplace 16 with fire 18, a flue 20, and a flue cover 22. An air intake blower 24, having electrical leads 26, is attached to conduit 12 on the exterior section of a dwelling 28. Conduit 12 has a U-shaped section 30 that essentially traverses the entire flue 20 to in close proximity to fire 18. Insulation means 32 surrounds conduit 12 in the section between the flue 20 and the dwelling 28. Conduit 12 includes a plurality of hot air discharge vents 34 attached thereto and positioned within dwelling 28.

With continual reference to the drawings for operation of the invention, in operation exterior air in conduit 12 is heated by the fire 18 as the hot air in conduit 12 rises to flow toward discharge vents 34, air is drawn in from the exterior of the dwelling 28 for circulation. To assist and enhance the circulation, blower 24 is utilized to suck air into conduit 12 from the atmosphere and force same into the structure. Blower 24 is also utilized to prevent cold air from seeping through cracks, crevices, or the like, in the dwelling 28 when it exhausts the heated air into the interior of the dwelling 28 (which is normally fairly air tight in the wintertime) through discharge vents. This exhaustion of heated air causes the interior of the dwelling 28 to be pressurized, thereby preventing cold air from seeping through cracks and crevices in the dwelling 28 caused by the fireplace 16 flue draft discharging heated air through the flue 20 into the exterior of the dwelling 28.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A heating apparatus for a dwelling having a fireplace with a flue comprising a conduit having an inlet terminating in the exterior of the dwelling and a discharge terminating within the dwelling, said conduit communicating with said flue; an exterior air intake blower attached to said exterior to enhance circulation; said conduit has a structure defining a U-shaped section within said flue, said conduit extending down said flue to be in close proximity with any heating means within said fireplace, said conduit exiting out of said fireplace into the atmosphere in proximity to the point of entry of said conduit into said fireplace and enters said dwelling at a place remote from said fireplace; and insulation means surrounding said conduit between said fireplace and said dwelling.

2. A method of heating a dwelling having a fireplace and a flue therefor comprising the steps of:

(a) introducing air into an upper portion of said flue from the exterior of the dwelling through a conduit communicating with said flue and fireplace;

(b) removing air through said conduit from said fireplace flue in close proximity to the point of introducing step (a) and exterior said dwelling;

(c) extending said removing conduit in the atmosphere from said flue to said dwelling at a place remote from said fireplace;

(d) insulating said removing conduit extending from said fireplace flue to said dwelling at a place remote from said flue;

(e) exhausting said conduit into the interior of said dwelling, whereby in operation the fireplace heat on said conduit is operative to draw air from the exterior and circulate warm air into the dwelling; and (f) attaching an air-suction zone in the portion of said conduit located in the exterior of said dwelling to enhance the circulation of air.

3. A method of preventing cold air from seeping through cracks, crevices, or the like, in a structure having a fireplace with a flue comprising the steps of:

(a) intaking air from the exterior of the structure through a conduit communicating with the fireplace and having an air-suction zone in a portion of said conduit located exterior of said structure;

(b) circulating said air of step (a) through said conduit in close proximity to heating means in said fireplace to heat said air of step (a), said circulating being assisted to said air-suction zone;

(c) removing air through said conduit from said fireplace in close proximity to the point of introducing the air from the exterior of the structure into the top of the flue of the fireplace;

(d) extending said removing conduit in the atmosphere from said flue of said fireplace to said structure at a place remote from said flue of said fireplace;

(e) insulating said removing conduit extending from said flue of said fireplace to said structure at a place remote from said flue of said fireplace; and (f) forcing said heated air of step (b) into the interior of the structure, said forcing being assisted by said air-suction zone and causing the interior of the structure to be pressurized thereby preventing cold air from seeping through cracks, crevices, or the like, in the structure caused by the fireplace flue draft discharging heated air through said flue into the exterior of the structure.

* * * * *

UNITED STATES PATENT AND TRADEMARK OFFICE

CERTIFICATE OF CORRECTION

PATENT NO. : 4,325,509

DATED : April 20, 1982

INVENTOR(S) : Leonard C. Base

It is certified that error appears in the above-identified patent and that said Letters Patent are hereby corrected as shown below:

Column 3, line 20, delete "to" and insert therefor ---by---.

Signed and Sealed this

*Twentieth* Day of *July 1982*

[SEAL]

*Attest:*

GERALD J. MOSSINGHOFF

*Attesting Officer*

*Commissioner of Patents and Trademarks*